United States Patent [19]

Higby et al.

[11] Patent Number: 4,865,570

[45] Date of Patent: Sep. 12, 1989

[54] MARINE PROPULSION DEVICE SHIFT APPARATUS

[75] Inventors: Jeffrey B. Higby, Waukegan; Kennedy K. McElroy, Jr., Lindenhurst, both of Ill.; Philip A. Zorc, St. Joseph, Mich.

[73] Assignee: Outboard Marine Corporation, Waukegan, Ill.

[21] Appl. No.: 294,910

[22] Filed: Jan. 6, 1989

Related U.S. Application Data

[63] Continuation of Ser. No. 82,829, Aug. 6, 1987, abandoned.

[51] Int. Cl.[4] ..... B63H 21/24

[52] U.S. Cl. ..... 440/86; 440/75; 74/475

[58] Field of Search ..... 440/1, 49, 75, 84, 86, 440/900; 74/469, 471 R, 473 P, 475, 479, 480 R, 480 B

[56] References Cited

U.S. PATENT DOCUMENTS

| | | | |
|---|---|---|---|
| 2,756,855 | 7/1956 | Kloss | 192/41 |
| 3,556,041 | 1/1971 | Shimanckas | 115/34 |
| 3,919,964 | 11/1975 | Hagen | 115/34 |
| 4,302,196 | 11/1981 | Blanchard | 440/75 |
| 4,318,702 | 3/1982 | Stacey | 440/75 |
| 4,442,730 | 4/1984 | Snoy | 74/475 |
| 4,527,441 | 7/1985 | Nakahama | 74/378 |
| 4,530,667 | 7/1985 | McCormick | 440/75 |
| 4,560,355 | 12/1985 | McCormick | 440/86 |
| 4,668,198 | 5/1987 | Nakamura | 440/86 |

FOREIGN PATENT DOCUMENTS

| | | | |
|---|---|---|---|
| 58-185396 | 10/1983 | Japan | 440/86 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

A marine propulsion device comprising a lower gearcase, a propeller shaft having thereon a propeller and being rotatably mounted in the lower gearcase, a drive gear rotatably mounted in the lower gearcase, a transmission for causing driving engagement between the drive gear and the propeller shaft, a lever rotatably mounted in the lower gearcase and operably connected to the transmission for actuation thereof in response to rotation of the lever, and a detent mechanism for releasably retaining the lever in a predetermined position.

23 Claims, 1 Drawing Sheet

MARINE PROPULSION DEVICE SHIFT APPARATUS

This is a continuation of Ser. No. 082,829, filed 8.6.87 now abandoned.

BACKGROUND OF THE INVENTION

The invention relates to marine propulsion device shift apparatus, and, more particularly, to apparatus for shifting a reversible transmission in the lower gearcase of a marine propulsion device.

The prior art includes many such shift apparatus. Typically, a reversible transmission in the lower gearcase of a marine propulsion device includes a control member which is movable axially of the propeller shaft for actuating the transmission. The shift apparatus provides means for moving the control member axially in response to operator actuation of a remotely located control device.

Known marine propulsion devices include detent means for releasably retaining the transmission in neutral in the absence of an operator applied force. Such detent means can be part of the transmission (See, e.g., U.S. Hagen Pat. No. 3,919,964) or can be built into a bearing housing rotatably supporting the propeller shaft. Known detent means have complicated constructions and are therefore relatively costly.

| U.S. Pat. Nos.: | | |
|---|---|---|
| Blanchard | 4,302,196 | Nov. 24 1981 |
| Kloss | 2,756,855 | July 31, 1956 |
| Shimanckas | 3,556,041 | Jan. 19, 1971 |
| Stacey | 4,318,702 | Mar. 19, 1982 |
| Shoy | 4,442,730 | Apr. 17, 1984 |
| Nakahama | 4,527,441 | July 9, 1985 |
| McCormick | 4,530,667 | July 23, 1985 |
| Hagen | 3,919,964 | Nov. 18, 1975 |

SUMMARY OF THE INVENTION

The invention provides a marine propulsion device comprising a lower gearcase, a propeller shaft having thereon a propeller and being rotatably mounted in the lower gearcase, a drive gear rotatably mounted in the lower gearcase, a transmission for selectively effecting driving engagement between the drive gear and the propeller shaft, a lever rotatably mounted in the lower gearcase and operably connected to the transmission for actuation thereof in response to rotation of the lever, and detent means for releasably retaining the lever in a predetermined position.

In one embodiment, the transmission is shiftable between drive and neutral, the lever is movable between a drive position and a neutral position, and the detent means retains the lever in the neutral position.

In one embodiment, the marine propulsion device further comprises operator actuated shift means for causing rotation of the lever.

In one embodiment, the lever is mounted in the lower gearcase for rotation about an axis, the shift means includes a pivot member having an end and being spaced from the axis and connected to the lever for rotation therewith about the axis, and a link connected to the pivot member for moving the member and thereby rotating the lever about the axis, and the detent means includes means defining a wall located adjacent the end of the pivot member, and releasably interengaging means on the wall and on the end of the pivot member.

In one embodiment, the wall defining means includes a bracket forming generally parallel, planar, opposed first and second surfaces, the axis extends generally perpendicularly to the surfaces, the lever is mounted on the bracket and between the surfaces for rotation relative thereto about the axis, the pivot member is a tube having therethrough a passage extending generally perpendicularly to the surfaces, the passage having opposite ends respectively located adjacent the first and second surfaces, and the interengaging means includes a recess in the first surface and a recess in the second surface, the recesses being located on a common line extending generally perpendicularly to the surfaces, a member located in the end of the passage adjacent the first surface, a member located in the end of the passage adjacent the second surface, and means biasing the members outwardly from the passage and against the surfaces so that the members engage the recesses when the lever is in the predetermined position.

In one embodiment, the bracket has a U-shaped construction and includes a generally planar base having opposite ends, a generally planar first arm extending generally perpendicularly to the base from one of the ends, and a generally planar second arm extending generally perpendicularly to the base and parallel to the first arm from the other of the ends, the first arm having an inner surface facing the second arm and forming the first surface, and the second arm having an inner surface facing the first arm and forming the second surface.

In one embodiment, the bracket is made of stamped metal.

In one embodiment, the bracket is made of powdered metal.

The invention also provides a marine propulsion device comprising a lower gearcase, a propeller shaft having thereon a propeller and being rotatably mounted in the gearcase, a drive gear rotatably mounted in the gearcase, a transmission for selectively effecting driving engagement between the drive gear and the propeller shaft, a bracket fixedly mounted on the gearcase, and a lever rotatably mounted on the bracket and operably connected to the transmission for actuation thereof in response to rotation of the lever.

In one embodiment, the marine propulsion device further comprises detent means for releasably retaining the lever in a predetermined position relative to the bracket.

In one embodiment, the base of the bracket is mounted on the gearcase.

A principal feature of the invention is the provision of a shift apparatus including a lever rotatably mounted in a lower gearcase and operably connected to a transmission for actuation thereof in response to rotation of the lever, and detent means for releasably retaining the lever in the neutral position. Instead of operating on the transmission itself, the detent means operates on the lever which actuates the transmission. This permits use of a simple and inexpensive detent mechanism.

Another principal feature of the invention is the provision of a shift apparatus including a bracket fixedly mounted within a lower gearcase, and a lever rotatably mounted on the bracket and operably connected to a transmission for actuation thereof in response to rotation of the lever. The bracket, which is preferably made of stamped metal or powdered metal, is a simple, inexpensive and effective means for mounting the lever within the lower gearcase. Also, the bracket facilitates assembly of the shift apparatus and use of the above-described detent means operable on the lever.

Other principal features and advantages of the invention will become apparent to those skilled in the art upon review of the following detailed description, claims and drawings.

Figures 1, 2, 3, 4, 5, 6, 7:
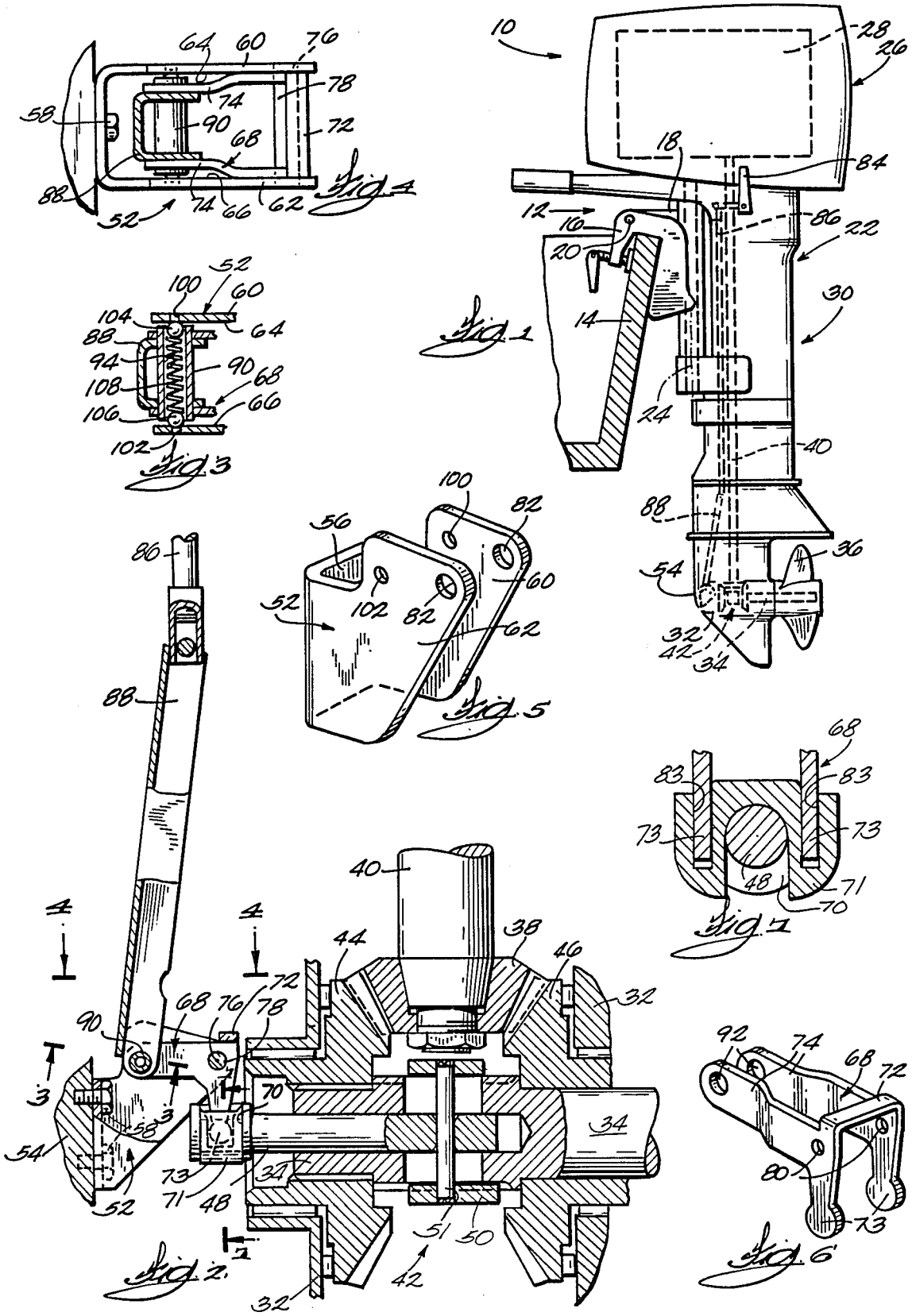
FIG. 1 is a side elevational view of the marine propulsion device embodying the invention.
FIG. 2 is an enlarged, vertical cross-sectional view of the shift apparatus.
FIG. 3 is a view taken along line 3—3 in FIG. 2 but showing the entire horizontal extent of the shift apparatus.
FIG. 4 is a cross-sectional view taken along line 4—4 in FIG. 2.
FIG. 5 is a perspective view of the bracket.
FIG. 6 is a perspective view of the lever.
FIG. 7 is a cross-sectional view taken along line 7—7 in FIG. 2.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As shown in FIG. 1, the marine propulsion device 10 comprises a mounting bracket or assembly 12 fixedly mounted on the transom 14 of a boat. In the preferred embodiment, the assembly includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24, and for common pivotal movement therewith about the tilt axis 20. The propulsion unit 22 includes a power head 26 which includes an internal combustion engine 28. The propulsion unit 22 also includes a lower unit 30 which supports the power head 26 and which includes a lower gearcase 32.

As shown in FIGS. 1 and 2, the marine propulsion device 10 also comprises a generally horizontal propeller shaft 34 having thereon a propeller 36 and being rotatably mounted in the lower gearcase 32, and a drive bevel gear 38 rotatably mounted in the lower gearcase 32. The engine 28 is drivingly connected to the drive gear 38 by a crankshaft 40.

The marine propulsion device 10 further comprises a reversible transmission 42 for selectively effecting driving engagement between the drive gear 38 and the propeller shaft 34. While various suitable transmissions can be employed, in the preferred embodiment, the transmission 42 is located in the lower gearcase 32 and includes (see FIG. 2) a pair of facing, axially spaced bevel gears 44 and 46 which are rotatably carried on the propeller shaft 34 and which mesh with the drive gear 38. The transmission 42 also includes a dog clutch 50 which is splined to the exterior of the propeller shaft 34 for common rotation therewith and which is movable axially of the propeller shaft 34 for selective and alternative engagement with the spaced bevel gears 44 and 46.

The transmission also includes a selector shaft 48 which extends through an axial bore in the propeller shaft 34 and which is movable axially of the propeller shaft 34. The selector shaft 48 has thereon a pin 51 which is engageable with the dog clutch 50 for moving the dog clutch 50 with the selector shaft 48 axially of the propeller shaft 34. Thus, the selector shaft 48 is movable axially of the propeller shaft 34 for selectively and alternatively causing driving engagement between the bevel gears 44 and 46 and the propeller shaft 34. Such an arrangement is disclosed in full detail in U.S. Hagen Pat. No. 3,919,964, which is incorporated herein by reference.

The transmission 42 transmits forward driving power to the propeller shaft 34 when the dog clutch 50 is in engagement with one of the gears 44 and 46, transmits reverse driving power to the propeller shaft 34 when the dog clutch 50 is in engagement with the other of the gears 44 and 46, and is in neutral when the dog clutch 50 is between and disengaged from both of the gears 44 and 46. Thus, axial movement of the selector shaft 48 shifts the transmission 42 between forward, neutral and reverse.

The marine propulsion device 10 further comprises (see FIGS. 2–5) a bracket 52 fixedly mounted within or on the lower gearcase 32. In the preferred embodiment, the lower gearcase 32 includes a generally vertical forward wall 54, and the bracket 52 is mounted on the inner surface of the wall 54. In the preferred embodiment, as best shown in FIG. 4, the bracket 52 has a U-shaped construction and is made of stamped metal. In alternative embodiments, the bracket 52 can be made of powdered metal. The bracket 52 includes a generally planar base 56 which has opposite ends and which is mounted on the gearcase 32 by suitable means such as screws 58. The bracket 52 also includes a generally planar first arm 60 which extends generally perpendicularly to the base 56 from one of the ends, and a generally planar second arm 62 which extends generally perpendicularly to the base 56 and parallel to the first arm 60 from the other of the ends. The first arm 60 has an inner surface facing the second arm 62 and forming a first surface 64, and the second arm 62 has an inner surface facing the first arm 60 and forming a second surface 66 parallel to the first surface 64.

The marine propulsion device 10 further comprises (see FIGS. 2–4 and 6) a lever 68 rotatably mounted on the bracket 52 and operably connected to the transmission 42 for actuation thereof in response to rotation of the lever 68. In the preferred embodiment, as best shown in FIG. 6, the lever 68 includes a pair of L-shaped, generally parallel, spaced apart portions connected by an integral cross-member 72. Each of the L-shaped portions includes a generally vertical arm 73, and a generally horizontal arm 74. As shown in FIG. 4, the length of the cross member 72 and thus the distance between the outer surfaces of the L-shaped portions is preferably approximately equal to the distance between the arms 60 and 62 of the bracket 52. Accordingly, the lever 68 fits within the bracket 52, as shown in FIG. 4, with the arms 74 of the lever 68 extending generally parallel to and adjacent to the arms 60 and 62 of the bracket 52. As shown in FIGS. 4 and 6, the outer or forward ends of the horizontal lever arms 74 are offset inwardly.

The lever 68 is mounted between the bracket arms 60 and 62 for rotation relative to the bracket 52 about an axis 76 extending generally perpendicularly to the surfaces 64 and 66 of the bracket 52, i.e., generally horizontally. While various suitable means can be employed for pivotally mounting the lever 68 on the bracket 52, in the illustrated construction, such means includes (see FIGS. 2 and 4) a pivot pin 78 which extends between the bracket arms 60 and 62 and on which the lever 68 is pivotally mounted. As shown in FIGS. 2, 4 and 7, the L-shaped portions of the lever 68 include a pair of aligned apertures 80 which are located approximately at the junction of the arms 73 and 74 and through which the pivot pin 78 extends. The outer ends of the pivot pin 78 are received in aligned bores 82 (see FIG. 5) in the bracket arms 60 and 62.

As noted previously, various suitable transmissions can be used, and, similarly, various suitable means can be used for operably connecting the lever 68 to the transmission 42. In the preferred embodiment, as shown in FIGS. 2 and 7, the forward end of the selector shaft 48 has therein an annular, circumferential groove 70 into which the vertical lever arms 73 extend. A cradle 71 seated in the groove 70 has a pair of spaced apart, vertically extending recesses 83 which receive the ends of the vertical lever arms 73. The cradle 71 transmits horizontal movement of the ends of the vertical lever arms 73 to the selector shaft 48 while permitting rotation of the selector shaft 48 relative to the cradle 71 and thus to the lever 68. Such an arrangement is known in the art and need not be described in greater detail.

The marine propulsion device 10 further comprises operator actuated shift means for causing rotation of the lever 68. While various suitable shift means can be employed, in the preferred embodiment, the shift means includes, on the propulsion unit 22, an operator actuated shift lever 84 (FIG. 1), and a generally vertical shift rod 86 (FIGS. 1 and 2) operatively connected to the shift lever 84 such that pivotal movement of the shift lever 84 causes vertical movement of the shift rod 86. Preferably, the shift rod 86 has an upper end connected to the shift lever 84 by conventional means, and a lower end. The shift means also includes (see FIGS. 1–4) a link 88 pivotally connected to the lower end of the shift rod 86 for vertical movement therewith. The link 88 preferably has an upper end connected to the shift rod 86, and a lower end.

The shift means further includes (see FIGS. 2–4) a pivot member 90 connected to the lever 68 for rotation therewith. In the preferred embodiment, the pivot member 90 is located in generally parallel, spaced relation to the axis 76. More particularly, the pivot member 90 extends through aligned apertures 92 (FIG. 6) in the forward ends of the lever arms 74 so that vertical movement of the pivot member 90 causes rotation of the lever 68 about the axis 76. As shown in FIGS. 3 and 4, the pivot member 90 has opposite ends respectively located adjacent the bracket surfaces 64 and 66, and the lower end of the link 88 is pivotally mounted on the pivot member 90 inside the lever arms 74. In the illustrated construction, as shown in FIG. 3, the pivot member 90 is a tube having therethrough a passage 94 extending generally perpendicularly to the bracket surfaces 64 and 66, i.e., generally horizontally. Thus, pivotal movement of the shift member 84 operates via the shift rod 86, the link 88, and the pivot member 9 to cause rotation of the lever 68.

The marine propulsion device 10 further comprises detent means for releasably retaining the lever 68 in a predetermined position relative to the bracket 52. In the preferred embodiment, the lever 68 is movable between forward, neutral and reverse positions corresponding to the forward, neutral and reverse positions of the selector shaft 48, and the detent means retains the lever 68 in its neutral position. While various suitable detent means can be employed, in the illustrated construction, such means includes interengaging means on the lever 68 and on one of the bracket arms 60 and 62. More particularly, the detent means preferably includes interengaging means on the lever 68 and on the bracket arm 60, and interengaging means on the lever 68 and on the bracket arm 62. Still more particularly, in the preferred embodiment, the detent means includes releasably interengaging means on the end of the pivot member 90 adjacent the bracket surface 64 and on the bracket wall 60, and releasably interengaging means on the end of the pivot member 90 adjacent the bracket surface 66 and on the bracket wall 62.

Still more particularly, in the preferred embodiment, the interengaging means include (see FIG. 3) a recess 100 in the surface 64 of the bracket arm 60 and a recess 102 in the surface 66 of the bracket arm 62, the recesses 100 and 102 being located on a common line extending generally perpendicularly to the surfaces 64 and 66. The interengaging means also include a detent member or ball 104 located in the passage 94 at the end of the pivot member 90 adjacent the bracket surface 64, a detent member or ball 106 located in the passage 94 at the end of the pivot member 90 adjacent the bracket surface 66, and means biasing the balls 104 and 106 outwardly from the passage 94 and against the adjacent bracket surfaces 64 and 66 so that the balls 104 and 106 engage the recesses 100 and 102 when the lever 68 is in the neutral position. While various suitable biasing means can be used, in the preferred embodiment, the biasing means includes a spring 108 located in the passage 94 between the balls 104 and 106.

As shown in FIGS. 3 and 5, in order to facilitate manufacturing of the bracket 52, the recesses 100 and 102 are preferably formed by aligned apertures or thru holes in the bracket arms 60 and 62. It is important that the diameters of the apertures or recesses 100 and 102 be smaller than the diameters of the balls 104 and 106 so that the balls do not pass through the apertures 100 and 102 or enter the apertures 100 and 102 so deeply that the balls 104 and 106 are difficult to disengage.

In alternative embodiments, the passage 94 can be closed at one end, and the detent means can include a single ball at the opposite end of the passage 94, and a single recess in the adjacent bracket surface 64 or 66, with the spring 108 biasing the ball into engagement with the single recess. This construction will provide at least some of the advantages of the invention.

The shift arrangement operates as follows: When the shift lever 84 is in its neutral position, the lever 68 is in its neutral position, the balls 104 and 106 extend into or engage the recesses 100 and 102, and the dog clutch 50 is located between the bevel gears 44 and 46, as shown in FIG. 2. In order to move the lever 68 from its neutral position, it is necessary to exert on the lever 68 a force sufficient to disengage the balls 104 and 106 from the recesses 100 and 102. When the shift lever 84 is rotated from its neutral position, the arms 73 of the lever 68 cause axial movement of the cradle 71 and of the selector shaft 48, thereby causing the dog clutch 50 to engage one of the bevel gears 44 and 46. This causes driving engagement of the drive gear 38 with the propeller shaft 34.

Various features of the invention are set forth in the following claims.

We claim:

1. A marine propulsion device comprising a lower gearcase, a propeller shaft rotatably mounted in said lower gearcase, a drive gear rotatably mounted in said lower gearcase, a transmission for selectively effecting driving engagement between said drive gear and said propeller shaft, a lever mounted in said lower gearcase for rotation about an axis and operably connected to said transmission for actuation thereof in response to lever rotation, operator actuated shift means for causing rotation of said lever and including a member connected to said lever at a location spaced from said axis for rotation therewith about said axis, and movable relative to said lever to rotate said lever about said axis, and detent means for releasably retaining said lever in a predetermined position and including means defining a wall located adjacent said member, and releasably interengaging means on said wall and on said member.

2. A marine propulsion device comprising a lower gearcase, a propeller shaft rotatably mounted in said gearcase, a drive gear rotatably mounted in said gearcase, a transmission for selectively effecting driving engagement between said drive gear and said propeller shaft, a bracket fixedly mounted on said gearcase, a lever mounted on said bracket for pivotal movement about an axis transverse to said propeller shaft, and operably connected to said transmission for actuation thereof in response to pivotal movement of said lever, a shift rod mounted for lengthwise movement in a direction transverse to each of said propeller shaft and the axis of lever pivotal movement and connected to said lever to effect pivotal movement of said lever in response to lengthwise movement of said shaft rod, and interchanging detent means on said lever and on said bracket for releasably retaining said lever in a predetermined position relative to said bracket.

3. A marine propulsion device comprising a lower gearcase, a propeller shaft rotatably mounted in said gearcase, a drive gear rotatably mounted in said gearcase, a transmission for selectively effecting driving engagement between said drive gear and said propeller shaft, a bracket fixedly mounted on said gearcase and including a surface, a lever mounted on said bracket for rotation relative thereto about an axis extending generally transversely to said bracket surface and along a path in adjacent relation to said bracket surface and operably connected to said transmission for actuation thereof in response to rotation of said lever, and interengaging detent means on said lever and on said bracket surface for releasably retaining said lever in a predetermined position relative to said bracket.

4. A marine propulsion device comprising a lower gearcase, a propeller shaft rotatably mounted in said lower gearcase, a drive gear rotatably mounted in said lower gearcase, a transmission for selectively effecting driving engagement between said drive gear and said propeller shaft, a lever mounted in said lower gearcase for rotation about an axis and operably connected to said transmission for actuation thereof in response to lever rotation, operator actuated shift means for causing rotation of said lever and including a pivot member having an end and being spaced from said axis and connected to said lever for rotation therewith about said axis, and a link connected to said pivot member for moving said member and thereby rotating said lever about said axis, and detent means for releasably retaining said lever in a predetermined position and including means defining a wall located adjacent said end of said pivot member, and releasably interengaging means on said wall and on said end of said pivot member.

5. A marine propulsion device as set forth in claim 4 wherein said wall defining means includes a bracket forming generally parallel, planar, opposed first and second surfaces, wherein said axis extends generally perpendicularly to said surfaces, wherein said lever is mounted on said bracket and between said surfaces for rotation relative thereto about said axis, wherein said pivot member is a tube having therethrough a passage extending generally perpendicularly to said surfaces, said passage having opposite ends respectively located adjacent said first and second surfaces, and wherein said interengaging means includes a recess in said first surface and a recess in said second surface, said recesses being located on a common line extending generally perpendicularly to said surfaces, a member located in said end of said passage adjacent said first surface, a member located in said end of said passage adjacent said second surface, and means biasing said members outwardly from said passage and against said surfaces so that said members engage said recesses when said lever is in said predetermined position.

6. A marine propulsion device as set forth in claim 5 wherein said bracket has a U-shaped construction and includes a generally planar base having opposite ends, a generally planar first arm extending generally perpendicularly to said base from one of said ends, and a generally planar second arm extending generally perpendicularly to said base and parallel to said first arm from the other of said ends, said first arm having an inner surface facing said second arm and forming said first surface, and said second arm having an inner surface facing said first arm and forming said second surface.

7. A marine propulsion device as set forth in claim 6 wherein said bracket is made of stamped metal.

8. A marine propulsion device as set forth in claim 4 wherein said transmission is shiftable between drive and neutral, wherein said lever is movable between a drive position and a neutral position, and wherein said detent means retails said level in said neutral position

9. A marine propulsion device comprising a lower gearcase, a propeller shaft rotatably mounted inn said lower gearcase, a drive gear rotatably mounted in said lower gearcase, a transmission for selectively effecting driving engagement between said drive gear and said propeller shaft, a lever mounted in said lower gearcase for pivotal movement about an axis transverse to said propeller shaft and operably connected to said transmission for actuation thereof in response to lever movement, operator actuated shift means for causing movement of said lever and including an elongated member supported for lengthwise movement in a direction generally perpendicular to said propeller shaft, and connected to said lever for effecting pivotal movement of said lever in response to lengthwise movement of said member, and detent means for releasably retaining said lever in a predetermined position and including means defining a wall located adjacent said member, and releasably interchanging means on said wall and on said member.

10. A marine propulsion device comprising a lower gearcase, a propeller shaft rotatably mounted in said gearcase, a drive gear rotatably mounted in said gearcase a transmission for selectively effecting a driving engagement between said drive gear and said propeller shaft, a bracket fixedly mounted on said gearcase and including generally parallel, planar opposed first and second surfaces. a lever rotatably mounted between said surfaces of said bracket for rotation relative thereto about an axis extending generally perpendicular to said surfaces and operably connected to said transmission for actuation thereof in response to rotation of said lever, and interengaging detent means on said lever and on said first and second surfaces for releasably retaining said lever in a predetermined position relative to said bracket.

11. A marine propulsion device as set forth in claim 10 wherein said transmission is shiftable between drive and neutral, where in said lever is movable between a drive position and a neutral position, and wherein said detent means retains said lever in said neutral position.

12. A marine propulsion device as set forth in claim 10 wherein said detent means also includes interengaging detent means on said lever and on the other of said first and second surfaces.

13. A marine propulsion device as set forth in claim 10 and further comprising operator actuated shift means for causing rotation of said lever.

14. A marine propulsion device as set forth in claim 13 wherein said lever is mounted on said bracket for rotation about an axis, wherein said shift means includes a pivot member having an end and being spaced from said axis and connected to said lever for rotation therewith about said axis, and a link connected to said pivot member for moving said member and thereby rotating said lever about said axis, and wherein said detent means includes, on said bracket, a wall located adjacent said end of said pivot member, and releasably interengaging means on said wall and on said end of said pivot member.

15. A marine propulsion device as set forth in claim 14 wherein said bracket forms generally parallel, planar, opposed first and second surfaces, wherein said axis extends generally perpendicularly to said surfaces, wherein said lever is mounted between said surfaces for rotation relative thereto about said axis, wherein said pivot member is a tube having therethrough a passage extending generally perpendicularly to said surfaces, said passage having opposite ends respectively located adjacent said first and second surfaces, and wherein said interengaging means includes a recess in said first surface and a recess in said second surface, said recesses being located on a common line extending generally perpendicularly to said surfaces, a member located in said end of said passage adjacent said first surface, a member located in said end of said passage adjacent said second surface, and means biasing said members outwardly from said passage and against said surfaces so that said members engage said recesses when said lever is in said predetermined position.

16. A marine propulsion device as set forth in claim 15 wherein said bracket has a U-shaped construction and includes a generally planar base having opposite ends, a generally planar first arm extending generally perpendicularly to said base from one of said ends, and a generally planar second arm extending generally perpendicularly to said base and parallel to said first arm from the other of said ends, said first arm having an inner surface facing said second arm and forming said first surface, and said second arm having an inner surface facing said first arm and forming said second surface.

17. A marine propulsion device as set forth in claim 16 wherein said base is mounted on said gearcase.

18. A marine propulsion device as set forth in claim 15 wherein said bracket is made of stamped metal.

19. A marine propulsion device comprising a lower gearcase, a propeller shaft rotatably mounted in said gearcase, a drive gear rotatably mounted in said gearcase, a transmission for selectively effecting driving engagement between said drive gear and said propeller shaft, a lever mounted on said gearcase for pivotal movement about an axis transverse to said propeller shaft and operably connected by said transmission for actuation thereof in response to rotation of said lever, a shift rod mounted for lengthwise movement in a direction transverse to each of said propeller shaft and the axis of pivotal movement of said lever and connected to said lever to effect pivotal movement thereof in response to lengthwise movement of said shift rod, and interengaging detent means on said lever and on said gearcase for releasably retaining said lever in a predetermined position relative to said gearcase.

20. A marine propulsion device comprising a lower gearcase, a propeller shaft rotatably mounted in said gearcase, a drive gear rotatably mounted in said gearcase, a reversible transmission for selectively effecting driving engagement between said drive gear and said propeller shaft, a bracket fixedly mounted on said gearcase, said bracket forming generally parallel, planar, opposed first and second surfaces, a lever mounted on said bracket and between said surfaces for rotation relative thereto about an axis extending generally perpendicularly to said surfaces, said lever being movable between forward, neutral and reverse positions and being operably connected to said transmission for actuation thereof in response to rotation of said lever, a pivot tube connected to said lever for rotation therewith about said axis, said tube having therethrough a passage extending generally perpendicularly to said surfaces, said passage having opposite ends respectively located adjacent said first and second surfaces, an operator actuated link connected to said tube for moving said tube and thereby rotating said lever, and detent means for releasably retaining said lever in said neutral position relative to said bracket, said detent means including a recess in said first surface and a recess in said second surface, said recesses being located on a common line extending generally perpendicularly to said surfaces, a ball located in said end of said passage adjacent said first surface, a ball located in said end of said passage adjacent said second surface, and means biasing said balls outwardly from said passage and against said surfaces so that said balls engage said recesses when said lever is in said neutral position.

21. A marine propulsion device as set forth in claim 20 wherein said bracket has a U-shaped construction and includes a generally planar base having opposite ends, a generally planar first arm extending generally perpendicularly to said base from one of said ends, and a generally planar second arm extending generally perpendicularly to said base and parallel to said first arm from the other of said ends, said first arm having an inner surface facing said second arm and forming said first surface, and said second arm having an inner surface facing said first arm and forming said second surface.

22. A marine propulsion device as set forth in claim 21 wherein said base is mounted on said gearcase.

23. A marine propulsion device as set forth in claim 21 wherein said bracket is made of stamped metal.

* * * * *